US007637479B2

(12) United States Patent
Lautzenhiser

(10) Patent No.: US 7,637,479 B2
(45) Date of Patent: Dec. 29, 2009

(54) HYDRAULIC PUMPING CYLINDER AND METHOD OF PUMPING HYDRAULIC FLUID

(75) Inventor: Lloyd L. Lautzenhiser, Verdi, NV (US)

(73) Assignee: Emhiser Research Limited, Parry Sound, Ontario (CA)

( * ) Notice: Subject to any disclaimer, the term of this patent is extended or adjusted under 35 U.S.C. 154(b) by 0 days.

(21) Appl. No.: 12/109,007

(22) Filed: Apr. 24, 2008

(65) Prior Publication Data

US 2009/0267040 A1 Oct. 29, 2009

(51) Int. Cl.
*B25B 23/00* (2006.01)

(52) U.S. Cl. ..... 254/8 B; 254/24; 254/2 B; 254/8 R; 60/479

(58) Field of Classification Search ..... 254/8 B, 254/2 B, 8 R, 93 R, 93 H, 2 R; 269/24, 27, 269/32

See application file for complete search history.

(56) References Cited

U.S. PATENT DOCUMENTS

| | | | | |
|---|---|---|---|---|
| 4,560,152 | A * | 12/1985 | Miller | 269/24 |
| 5,755,099 | A | 5/1998 | Hung | |
| 6,113,086 | A * | 9/2000 | Yonezawa | 269/24 |
| 6,247,307 | B1 * | 6/2001 | Hung | 60/479 |
| 6,450,481 | B1 | 9/2002 | Oxtoby | |
| 6,572,080 | B1 | 6/2003 | Delikatzis | |
| 6,622,485 | B2 * | 9/2003 | Hung | 60/477 |
| 6,742,334 | B2 * | 6/2004 | Fan | 60/479 |
| 7,040,091 | B2 * | 5/2006 | Fan | 60/479 |
| 2004/0065871 | A1 * | 4/2004 | Hsu | 254/8 B |
| 2007/0022750 | A1 | 2/2007 | Bitter | |

* cited by examiner

*Primary Examiner*—Lee D Wilson
(74) *Attorney, Agent, or Firm*—Taylor & Aust, P.C.

(57) ABSTRACT

A hydraulic jack including a frame and a pump connected to the frame. The pump includes a rod, a housing, a piston and a plurality of valves. The rod has a cross-sectional area. The housing has an end through which the rod slides. The piston is associated with said rod, with the piston establishing a rod side chamber and a piston side chamber within the housing. The piston having a cross-sectional area. The plurality of valves each are fluidly connected to the rod side chamber and/or the piston side chamber. The piston, the rod and the valves are arranged to provide a first hydraulic fluid flow associated with the cross-sectional area of the piston until a predetermined pressure is reached and a second hydraulic fluid flow associated with the cross-sectional area of the rod after the predetermined pressure is reached.

14 Claims, 7 Drawing Sheets

HYDRAULIC PUMPING CYLINDER AND METHOD OF PUMPING HYDRAULIC FLUID

BACKGROUND OF THE INVENTION

1. Field of the Invention

The present invention relates to a hydraulic pumping cylinder, and, more particularly, to a low-load rapid fluid movement pumping cylinder.

2. Description of the Related Art

Hydraulic cylinders are common devices used in industry and for the jacking of loads using a jacking mechanism having a input cylinder and an output cylinder. The output cylinder is used to lift the load to a predetermined height with a considerably small force utilized on the mechanical portion that moves the input cylinder. The working principal of the hydraulic jack system provides for an applied small force that moves the input piston of a small cross-sectional area and pushes the hydraulic fluid or oil into an output cylinder, which then forces an output piston of large cross-sectional area to jack up a load.

The path of the input piston is often far longer than that of the output piston. The input piston must be repeatedly pumped to jack a load to a predetermined position. During the jacking process, each stroke of the input piston moves the output piston based upon the fluid transfer from the input cylinder to the output cylinder. Typically the same number of pumping strokes is needed to move the jack to a predetermined height regardless of whether there is a load on the output cylinder or not. Under the no-load condition the rate at which the ram of the output cylinder extends, directly or by way of a lifting arm, is not noticeably changed from the rate at which it travels under a loaded condition.

A disadvantage of the systems presently in use is that time and energy are wasted in moving the output piston/ram to the desired location or to encounter a load which is to be moved and/or lifted. Solutions utilized prior to the present invention typically utilize many hydraulic components, which are complex and expensive to manufacture, and due to the additional number of parts are often unreliable.

What is needed in the art is an easy to operate and inexpensive to manufacture pumping cylinder system that moves a large quantity of hydraulic fluid under low pressure yet delivering high pressure when a load is encountered.

SUMMARY OF THE INVENTION

The present invention provides a hydraulic pumping cylinder.

The invention in one form is directed to hydraulic jack including a frame and a pump connected to the frame. The pump includes a rod, a housing, a piston and a plurality of valves. The rod has a cross-sectional area. The housing has an end through which the rod slides. The piston is associated with said rod, with the piston establishing a rod side chamber and a piston side chamber within the housing. The piston having a cross-sectional area. The plurality of valves each are fluidly connected to the rod side chamber and/or the piston side chamber. The piston, the rod and the valves are arranged to provide a first hydraulic fluid flow associated with the cross-sectional area of the piston until a predetermined pressure is reached and a second hydraulic fluid flow associated with the cross-sectional area of the rod after the predetermined pressure is reached.

An advantage of the present invention is that under a no-load or near no-load condition the pumping piston moves a large volume of hydraulic fluid as compared to when the fluid is under a high pressure resistance.

Another advantage of the present invention is that an output cylinder is rapidly moved under a no-load condition to thereby allow the output cylinder to rapidly engage a load to undertake the necessary work.

Yet another advantage of the present invention is that the apparatus is inexpensive to manufacture and can be readily adapted into systems currently using prior art designs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
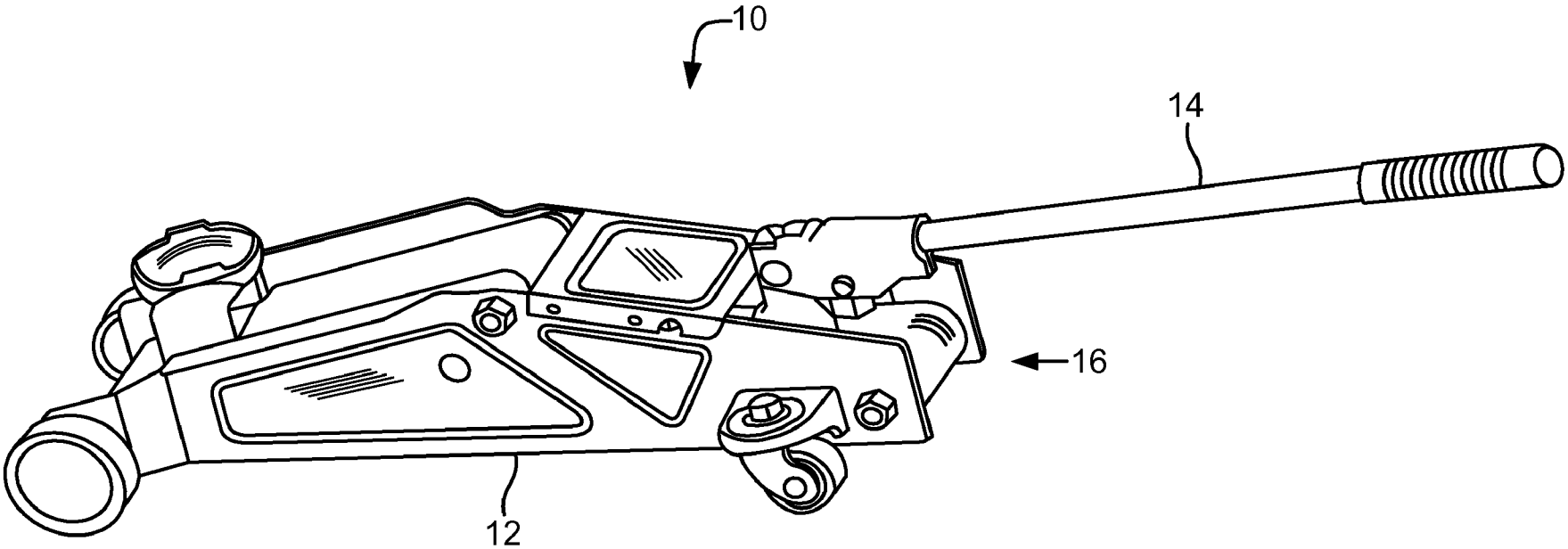
FIG. 1 illustrates an application of an embodiment of the present invention in the form of a manually operated hydraulic jack.

Referring now to the drawings, and more particularly to FIG. 1, there is shown a hydraulic jack 10 having a frame 12, a handle 14 and a hydraulic pump 16. Hydraulic jack 10 is similar on the exterior to numerous jack systems currently in use. Jack 10 is rolled under a device, such as a vehicle, and it is positioned so that the lifting arm will engage a portion of the underside of the car. Handle 14 is pumped up and down to actuate hydraulic pump 16, which is hydraulically linked to an output cylinder, not shown, that extends the lifting arm for the purpose of jacking the load, such as the vehicle. Hydraulic jack 10 may utilize any one of the embodiments to be described hereinafter as a hydraulic pump 16.

Figure 2:
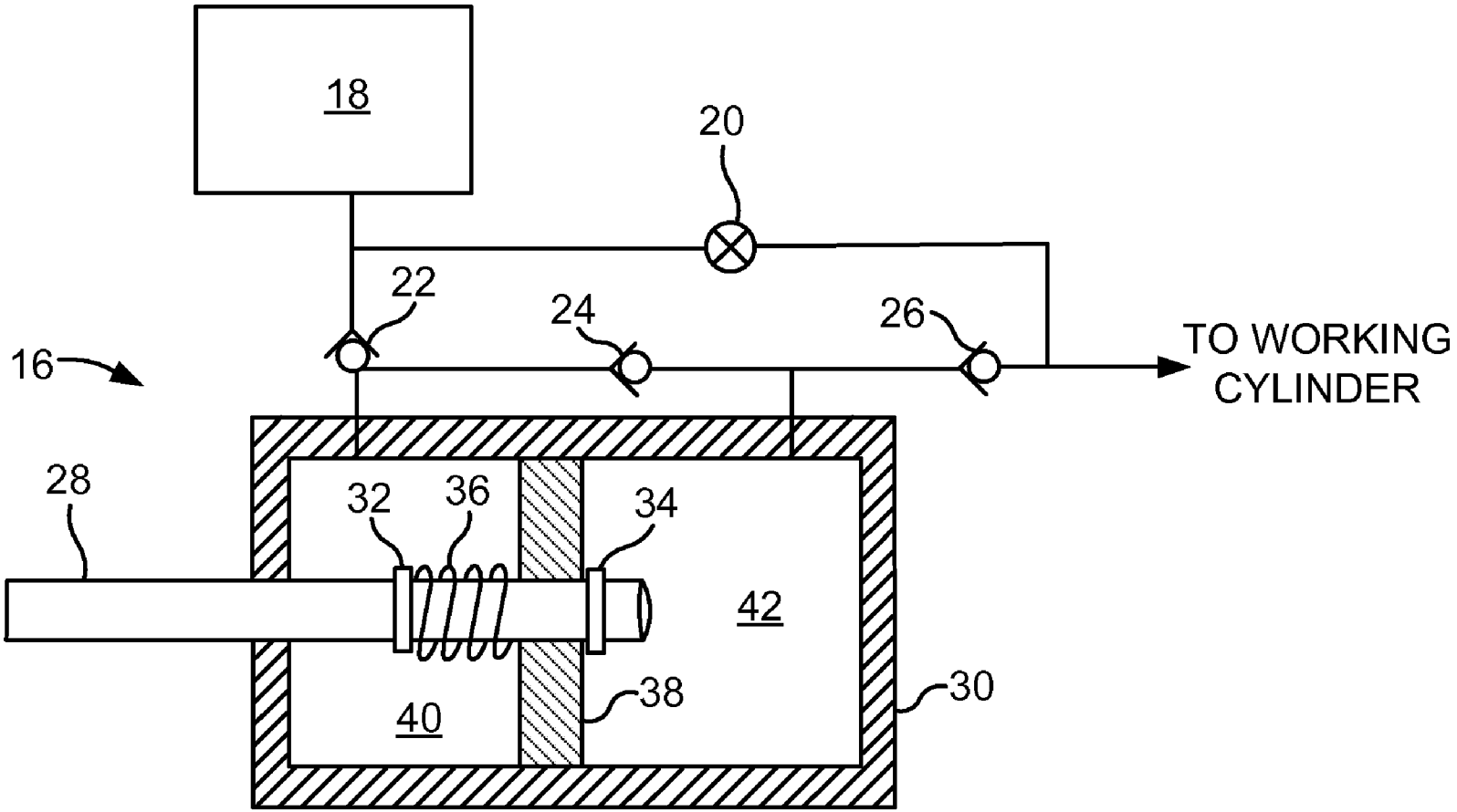
FIG. 2 is a partially schematicized and cross-sectional view of one embodiment of the present invention.

Now, additionally referring to FIG. 2 there is shown a hydraulic pump 16 that includes connections to a reservoir 18, a valve 20, check valves 22, 24 and 26, a shaft 28, a housing 30, a retainer 32, a retainer 34, a spring 36, a piston 38, that operates within housing 30 having chambers 40 and 42 defined by the relative position of piston 38. Chamber 40 is herein referred to as a rod side or shaft side of the assembly and chamber 42 is herein referred to as a piston side of the assembly even though in some of the embodiments shaft 28 will, during its operation, extend in to chamber 42. Reservoir 18 holds hydraulic fluid that is pumped by way of hydraulic pump 16 to a working cylinder, not shown. Reservoir 18 may be vented to the air and allows a fluid flow into and out of reservoir 18 as directed by actions carried out by the positioning of valve 20 and pumping on handle 14. Valve 20 may be manually operated or under the control of an automatic control system. Valve 20 is opened to allow fluid flow from the work cylinder back into reservoir 18. Typically the fluid in the work cylinder, when it is under a load, is under pressure that has been built up by the operation of hydraulic pump 16.

Check valves 22, 24 and 26 allow for fluid to enter into housing 30 at appropriate times and to exit in a pressurized manner through check valve 26 to the work cylinder. Check valves 22, 24 and 26 may be spring biased to allow fluid flow through only in one direction.

Shaft 28, also known as a rod 28, is connected either directly to handle 14 or by way of a leveraging method utilized by those familiar with the art. Shaft 28 is hydraulically sealed where it enters into housing 30 and shaft 28 is slidingly engaged with housing 30 allowing shaft 28 to enter and exit in a longitudinal direction of shaft 28. Hydraulic lines are shown schematically entering through portions of housing 30 and may be appropriately positioned along end portions of housing 30 or along the sides thereof. The actually positioning of the hydraulic lines is not limited by the positions shown in the figures and their positions are merely for the ease of illustration and explanation of the present invention.

Connected to shaft 28 are retainers 32 and 34 which limit the movement of piston 38 along shaft 28 within housing 30. Retainers 32 and 34 may be a snap ring or other removable feature. Alternatively, at least one of retainers 32 and 34 may be an integral part of shaft 28. Spring 36 provides a biasing between retainer 32 and piston 38. Piston 38 is slidable along the interior walls of housing 30 and is also slidable along shaft 28, at least within the constraints of retainers 32 and 34. The shape of piston 38 corresponds to the interior shape of housing 30, which is typically a cylindrical shape, although other shapes are also possible. In a similar fashion shaft 28 is typically of a cylindrical nature although other shapes are also contemplated.

In operation of pumping piston 16, a shaft 28 is withdrawn completely to the left so that retainer 32 is against the inner housing wall of housing 30. In this position chamber 40 is much smaller than chamber 42. Force is applied to shaft 28 pushing it further into housing 30, presuming initially that the work cylinder has not encountered a load, the biasing force of spring 36 causes piston 38 to advance with shaft 28 with piston 38 proximate to or against retainer 34. As shaft 28 continues to move into housing 30. chamber 40 increases in size causing fluid to travel from reservoir 18 through check valve 22 into chamber 40. Fluid in chamber 42 is forced through the hydraulic line and through check valve 26 and is sent to the work cylinder. This cycle can be repeated with shaft 28 being moved longitudinally into and out of housing 30 causing large transfers of fluid to the work cylinder. When shaft 28 is moved out of housing 30, check valve 26 is closed and check valves 24 and 22 are open to allow for transfer of fluid into chamber 42. When shaft 28 is being moved out from housing 30 a large amount of hydraulic fluid is transferred from chamber 40 to chamber 42. The hydraulic fluid is introduced through check valve 22 since the overall displacement within housing 30 is being reduced since shaft 28 is being removed through the wall of housing 30.

When the work cylinder encounters a load, pressure in the line increases and as shaft 28 is further inserted into housing 30 the pressure in chamber 42 is such that piston 38 does not travel with shaft 28 and will instead slide along shaft 28 as shaft 28 is entering into housing 30. As shaft 28 continues to enter into housing 30, spring 36 may compress as piston 38 moves in the direction of shaft 28, but at a reduced rate in direction that shaft 28 is moving. Piston 38 moves along shaft 28. Check valve 26 will open to receive pressurized fluid from chamber 42. In this manner the movement of shaft 28 displaces a smaller amount of fluid when piston 38 stops tracking the movement of shaft 28, thereby providing for two different pumping volumes when shaft 28 is moved. The volume of fluid moved is based on the relative cross-sectional area of shaft 28 versus the cross-sectional area of piston 38 and shaft 28 when they are moving together.

Figure 3:
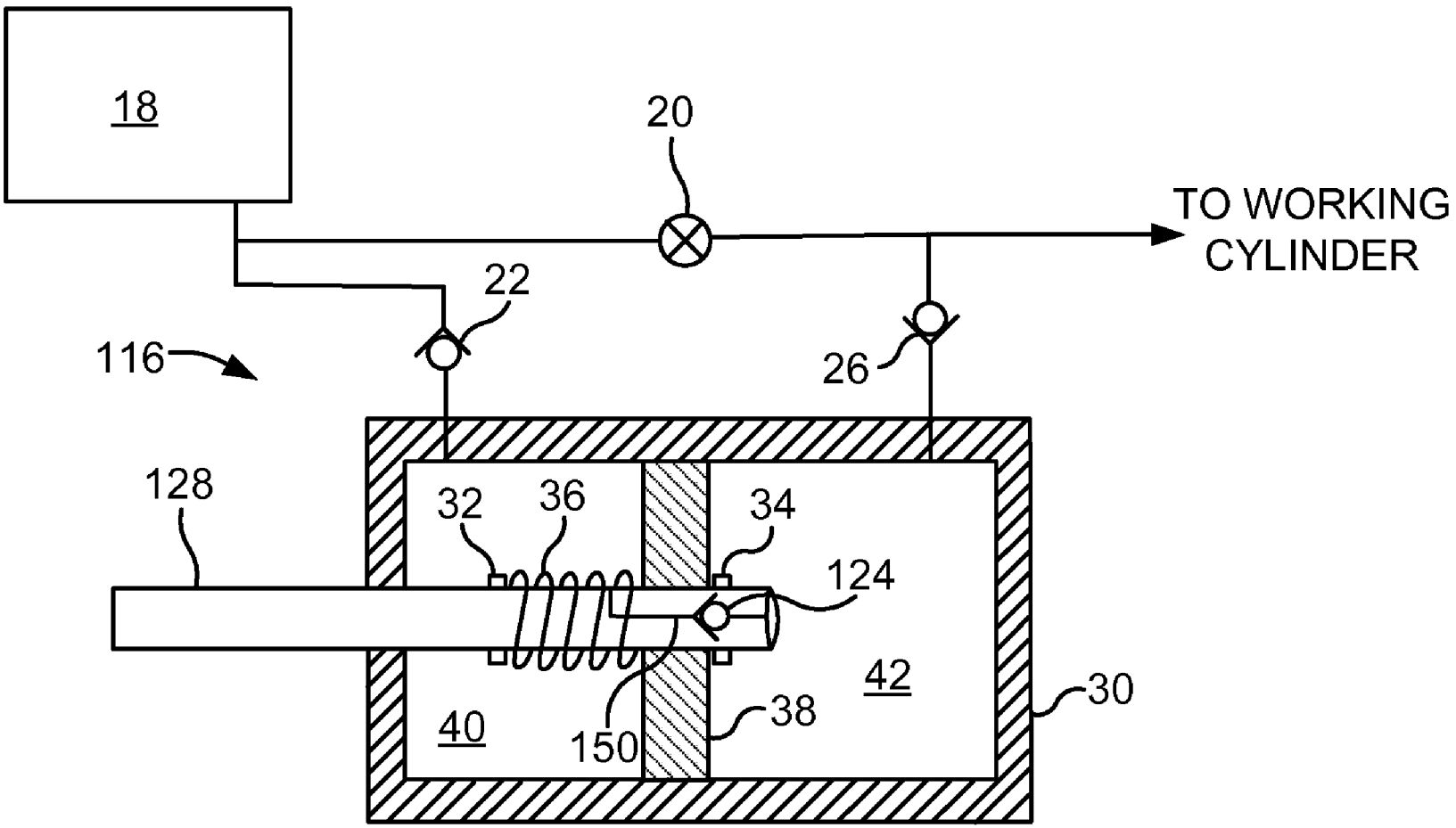
FIG. 3 is another partially schematicized and partially cross-sectional view of another embodiment of the present invention.

Now, additionally referring to FIG. 3 there is illustrated working piston 116 with some components that are the same as those described in the previous example, and some of the components that are similar but not identical to the previous embodiment being illustrated with a number that is one hundred higher than that illustrated in the previous figure. In this illustration a shaft 128 includes a passageway 150 that extends through a side of the shaft to the end of the shaft having a check valve 124 optionally positioned in passageway 150. Passageway 150 and check valve 124 are illustrated schematically and may be implemented in numerous ways and there may exist more than one passageway that extends through an interior portion of shaft 128. The operation of this embodiment is substantially similar to that previously described with some depth in the previous description. The positioning of check valve 124 in shaft 128 thereby precludes the need for a check valve 24 external to housing 30. It is also possible that check valve 124 may be eliminated or may consist of a flapping mechanism possibly on the end of shaft 128.

Figure 4:
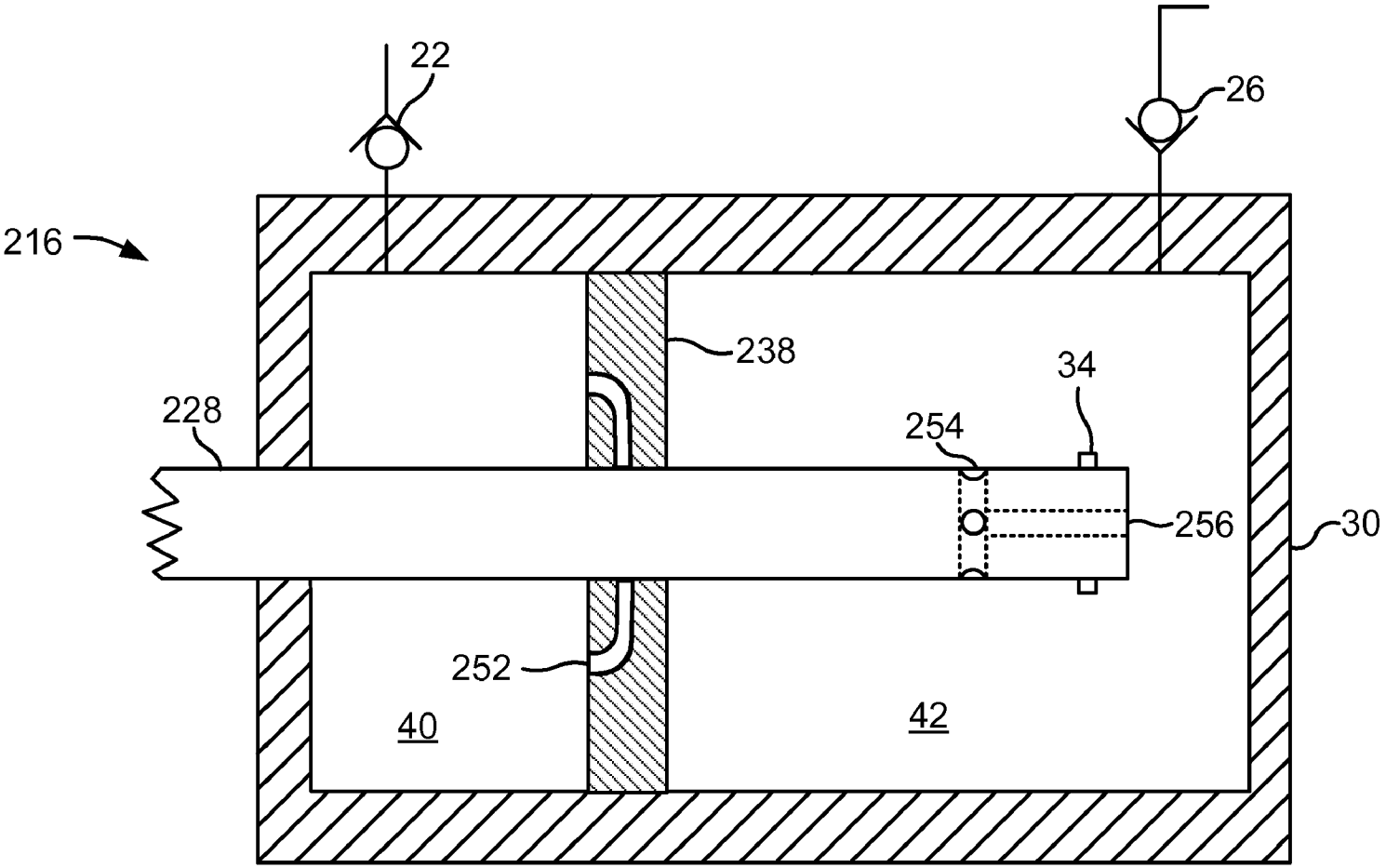
FIG. 4 is yet another partially schematicized and partially cross-sectional view of another embodiment of the present invention.

Now, additionally referring to FIG. 4, there is illustrated yet another embodiment of the present invention again having certain portions with the two least significant digits remaining the same for similar parts used in the previous embodiments. Pumping cylinder 216 has a shaft 228 that has passageways 254 and 256. Passageways 252 are positioned in piston 238. In this embodiment when shaft 228 is positioned such that piston 238 is positioned between retainer 34 and passageway 254 that piston 238 will have a tendency to follow along with shaft 228 because fluid can flow through passageway 256 and 254 to substantially equalize the pressure in chambers 40 and 42. When high pressure is encountered by way of a load applied to the working cylinder, piston 238 no longer travels with shaft 228 and the displacement of shaft 228 as it enters housing 30 serves as the high pressure transfer of fluid through check vale 26 to the working cylinder. Piston 238 floats along shaft 228 within housing 30 and it is the displacement of fluid by the entry of shaft 228 into housing 30 that accounts for the pressurized exit of fluid by way of check valve 26. As shaft 228 is withdrawn from housing 30 pickup fluid enters by way of check valve 22 and piston 238 may even travel counter to a direction of shaft 228 until passageways 252 align with passageway 254 to allow fluid then to flow from chamber 40 to chamber 42.

Figure 5:
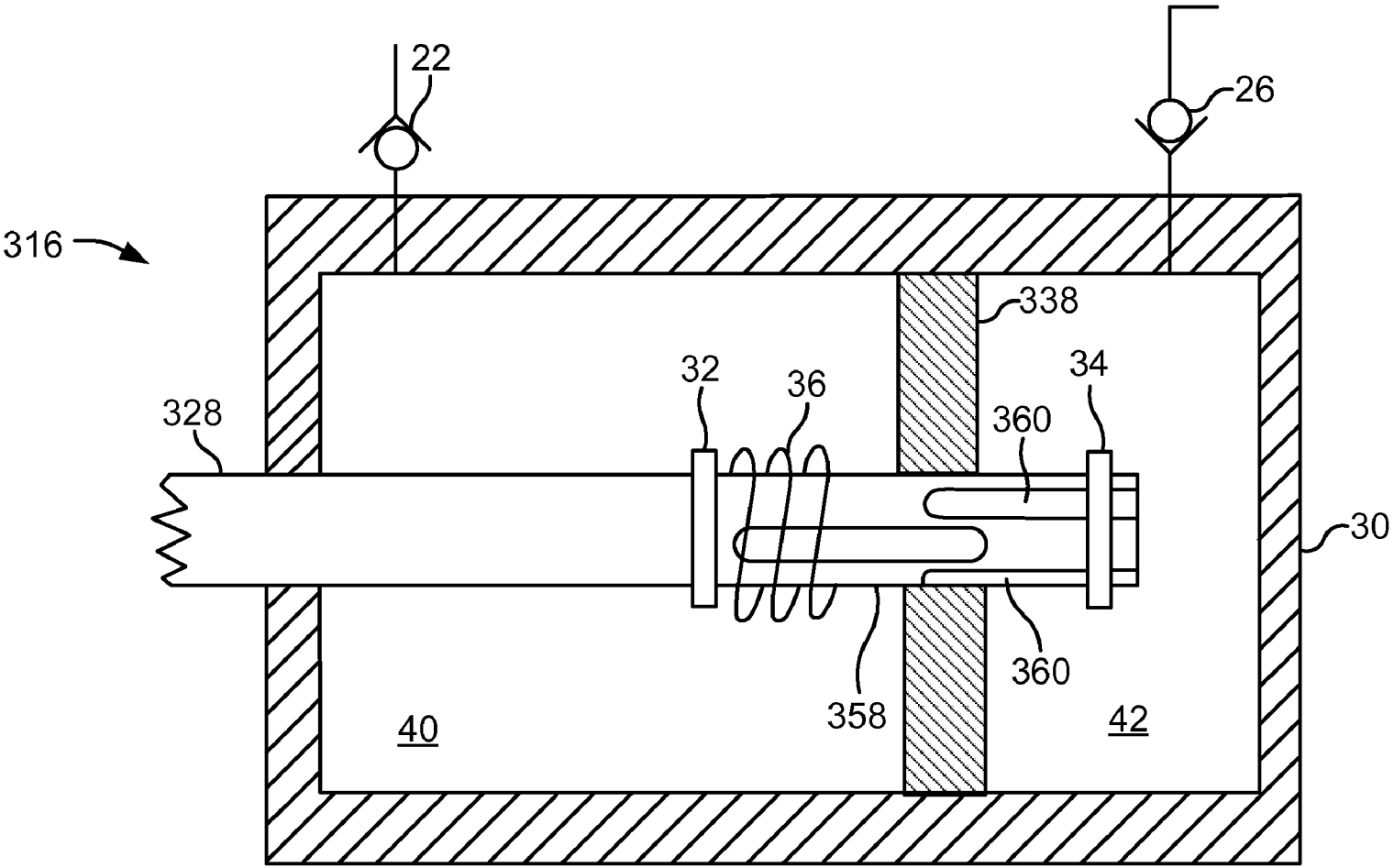
FIG. 5 is still yet another partially schematicized and partially cross-sectional view of another embodiment of the present invention.

Now, additionally referring to FIG. 5, there is illustrated a hydraulic pump 316 again having certain elements with the two least significant digits remaining the same for similar parts used in the previous embodiments. Shaft 328 enters into housing 30 and has grooves 358 and 360 along a portion of the length of shaft 328. Grooves 358 and 360 allow for fluid to pass from chamber 40 to chamber 42 and vice-versa based upon the positioning of grooves 358 and 360 relative to piston 338. When the portion of piston 338 that slides along shaft 328 is positioned so that it covers one end of groove 358 and one end of groove 360 and that particular position oil does not transfer between chambers 40 and 42 except perhaps a small amount due to leakage of the seals. In this position piston 338 will travel along with shaft 328 as it is moved in housing 30. Retainers 32 and 34 prevent piston 338 from disengaging with shaft 328 yet allows piston 338 to be in sliding contact with the surface of shaft 328. One end of groove 358 is positioned close to retainer 32 and the other end of groove 358 is positioned closer to retainer 34 than one end of groove 360. Although only one groove 358 is illustrated, more than one groove 358 may be positioned around the outer portion of shaft 328. Further, the length of overlap grooves 358 and 360 may not all be identical to each other. Once high pressure is encountered due to a load on the working cylinder, shaft 328 slides through piston 338 with the hydraulic fluid in chambers 40 and 42 being in communication by way of groove 358 as shaft 328 continues to move into housing 30. In this way high pressure fluid can be forced through check valve 26 to the working cylinder. When shaft 328 is being withdrawn from housing 30 piston 338 moves close to retainer 34 and makeup fluid is introduced by way of check valve 22 with the fluid flowing from chamber 40 into chamber 42 by way of grooves 360.

Various configurations utilizing biasing members such as a spring 36 are contemplated with even the possibility of more than one spring 36 having different biasing characteristics. The length of grooves, passageways positioning of retainer have been illustrated for the ease of illustration and explanation and are not determinative relative to their position, length or size in the actual manufacture of the pumping cylinder. Further, the relative sizes of the sliding piston and cross-sectional area of the shaft along with the size of housing 30 are simply for the ease of illustration and are not considered determinative of the final application.

Figure 6:
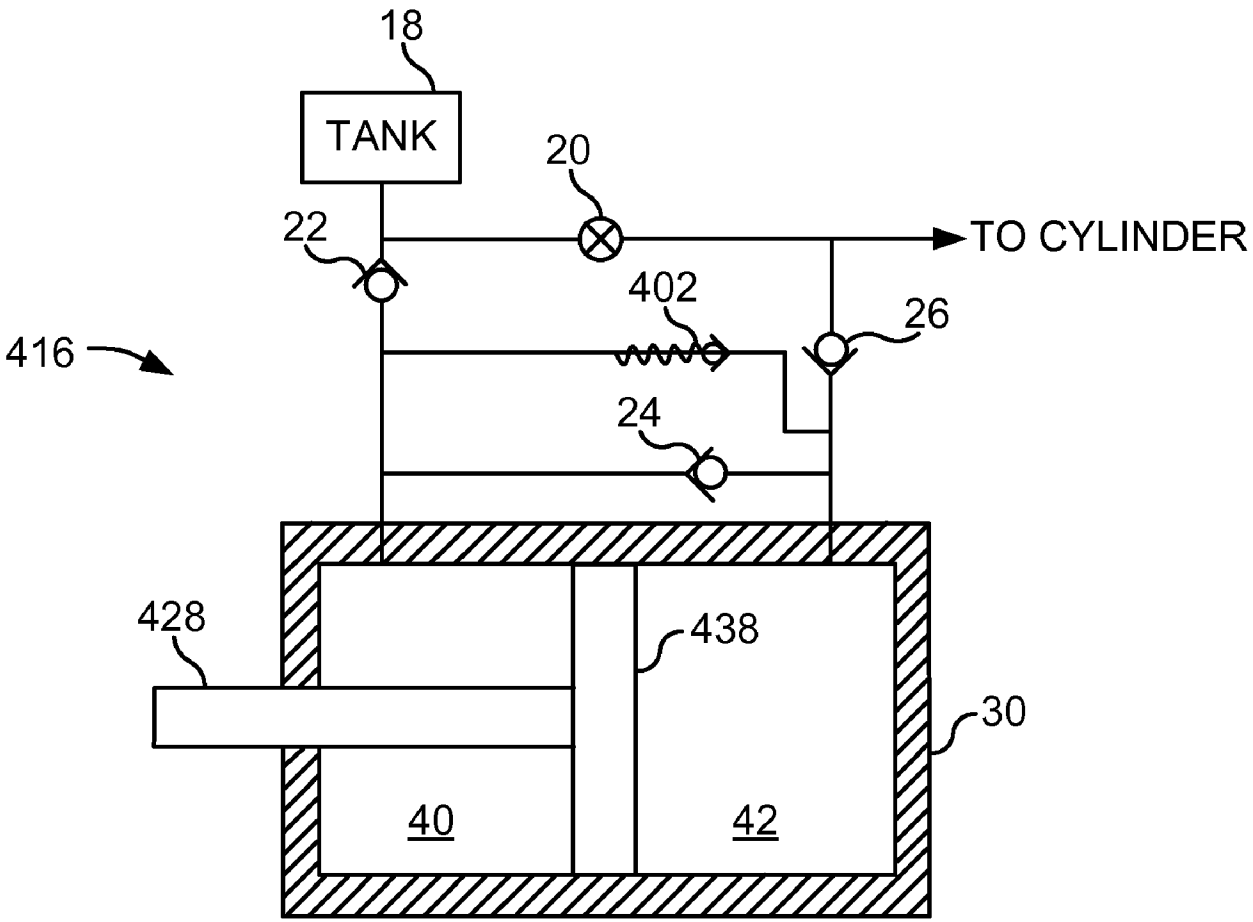
FIG. 6 is a further partially schematicized and partially cross-sectional view of another embodiment of the present invention.

Now, additionally referring to FIG. 6, there is illustrated a hydraulic pump 416 again having certain elements with the two least significant digits remaining the same for similar parts used in the previous embodiments. Shaft 428 enters into housing 30 and piston 438 is connected to an end of shaft 428. Regarding the external elements illustrated that have the same numbers as those illustrated in FIG. 2, the descriptions above apply here as well. Preloaded valve 402 precludes flow therethrough from the side connected to chamber 40 to the side connected to chamber 42. Preloaded valve 402 allows a flow therethrough from the side connected to chamber 42 to the side connected to chamber 40, once a predetermined differential pressure is exceeded. In this way the fluid supplied from chamber 42 to the working cylinder is of a high volume as long as the pressure is below the predetermined pressure. Once the pressure exceeds the predetermined value, which can be caused by the lifting arm contacting a load, then valve 402 allows a flow of fluid from chamber 42 to chamber 40. The fluid that is equivalent to the fluid displaced by the entrance of shaft 428 into chamber 40 is sent to the working cylinder at a higher pressure/lower volume since in this mode the effective cross-sectional area of pump 416 is the cross-sectional area of shaft 428. This very effectively produces a dual pressure pump.

Figure 7:
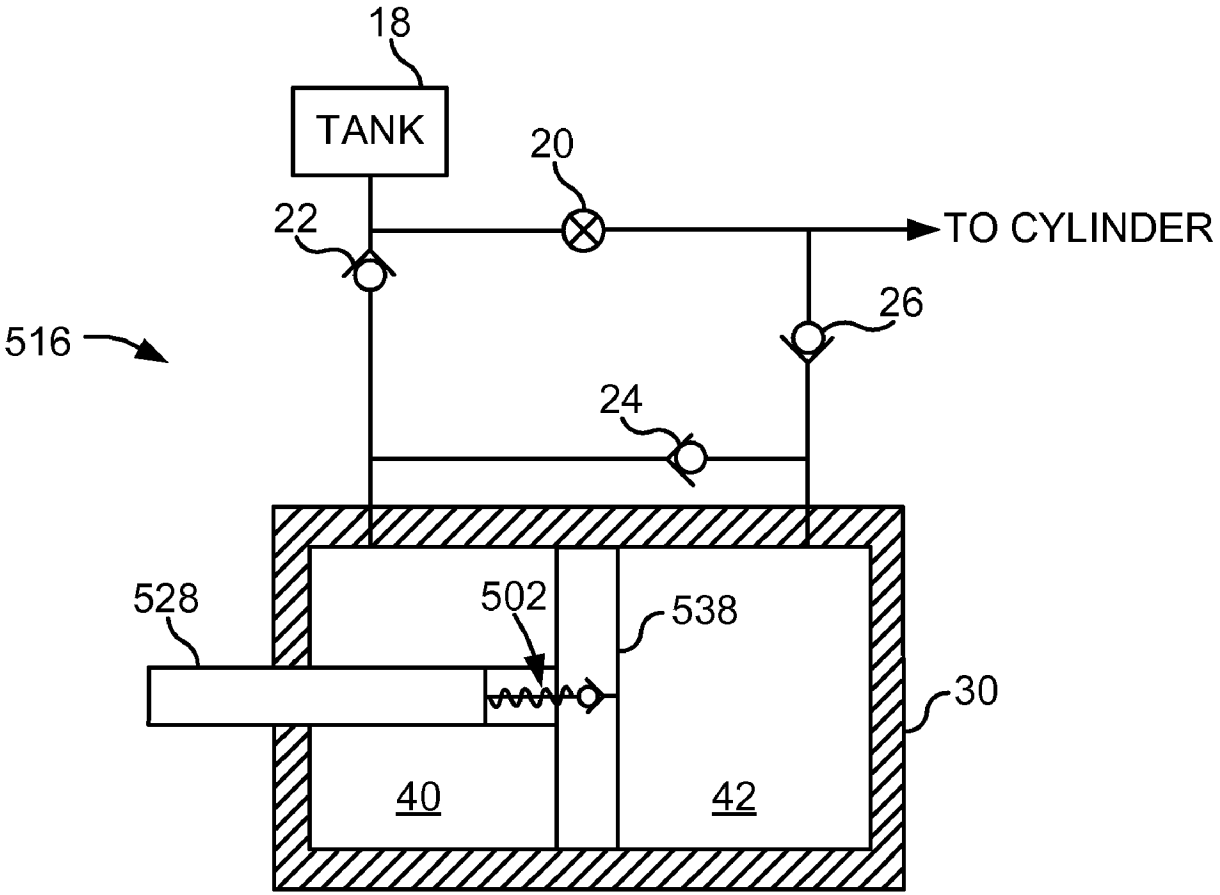
FIG. 7 is another partially schematicized and partially cross-sectional view of yet another embodiment of the present invention.

Now, additionally referring to FIG. 7, there is illustrated a hydraulic pump 516 again having certain elements with the two least significant digits remaining the same for similar parts used in the previous embodiments. Shaft 528 enters into housing 30 and piston 538 is connected to an end of shaft 528. Regarding the external elements illustrated that have the same numbers as those illustrated in FIG. 2, the descriptions above apply here as well. Preloaded valve 502 precludes flow therethrough from the side connected to chamber 40 to the side connected to chamber 42. Preloaded valve 502 allows a flow therethrough from the side connected to chamber 42 to the side connected to chamber 40, once a predetermined differential pressure is exceeded. In this way the fluid supplied from chamber 42 to the working cylinder is of a high volume as long as the pressure is below the predetermined pressure. Once the pressure exceeds the predetermined value, which can be caused by the lifting arm of the jack contacting a load, then valve 502 allows a flow of fluid from chamber 42 to chamber 40. The fluid that is equivalent to the fluid displaced by the entrance of shaft 528 into chamber 40 is sent to the working cylinder at a higher pressure/lower volume since in this mode the effective cross-sectional area of pump 516 is the cross-sectional area of shaft 528. While valve 502 is depicted as providing a fluid flow from the center of piston 538 through a portion of shaft 528 and out the side of shaft 528, it is also contemplated that the same function can be implemented if valve 502 were located in piston 538 exclusively.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic jack, comprising:

a frame; and a pump connected to said frame, said pump including:

a rod having a cross-sectional area;

a housing having an end through which said rod slides;

a piston associated with said rod, said piston establishing a rod side chamber and a piston side chamber within said housing, said piston having a cross-sectional area; and a plurality of valves each being fluidly connected to at least one of said rod side chamber and said piston side chamber, said piston, said rod and said valves being arranged to provide a first hydraulic fluid flow associated with said cross-sectional area of said piston until a predetermined pressure is reached and a second hydraulic fluid flow associated with said cross-sectional area of said rod after said predetermined pressure is reached, said piston being slidingly disposed inside of said hosing and said rod being slidingly retained by said piston, said rod being configured to pressurize hydraulic fluid as it slides through the piston thereby causing said second hydraulic fluid flow.

2. The hydraulic jack of claim 1, wherein said rod has a surface along a length of said rod, said rod including at least one of a groove along said surface and a fluid passageway having an end through said surface.

3. The hydraulic jack of claim 2, wherein said rod has a plurality of grooves along said surface.

4. The hydraulic jack of claim 3, wherein said plurality of grooves include a first groove and a second groove, said rod having an end disposed within said housing, said first groove having a first end and a second end, said first end of said first groove being proximate to said end of said rod, said second groove having a first end and a second end, said first end of said second groove being proximate to said second end of said first groove.

5. The hydraulic jack of claim 4, further comprising a retaining ring affixed to said rod between said end of said housing and said second end of said second groove.

6. The hydraulic jack of claim 5, wherein said piston is slidably positioned on said rod between said first end of said first groove and said retaining ring.

7. The hydraulic jack of claim 6, wherein said piston has a thickness proximate to said surface of said rod, said thickness being sufficient to simultaneously cover said second end of said first groove and said first end of said second groove.

8. The hydraulic jack of claim 1, wherein said rod side chamber and said piston side chamber being in fluid communication depending on at least one of a direction that said rod is moved relative to said housing and a position of said rod relative to said piston.

9. The hydraulic jack of claim 1, wherein one of said plurality of valves includes a valve that allows a fluid flow from said piston side chamber to said rod side chamber if a pressure of a fluid in said piston side chamber relative to a pressure in a fluid in said rod side chamber is above a predetermined value.

10. A hydraulic pump, comprising:

a rod having a cross-sectional area;

a housing having an end through which said rod slides;

a piston associated with said rod, said piston establishing a rod side chamber and a piston side chamber within said housing, said piston having a cross-sectional area; and a plurality of valves each being fluidly connected to at least one of said rod side chamber and said piston side chamber, said piston, said rod and said valves being arranged to provide a first hydraulic fluid flow associated with said cross-sectional area of said piston until a predetermined pressure is reached and a second hydraulic fluid flow associated with said cross-sectional area of said rod after said predetermined pressure is reached, said piston being slidingly disposed inside of said hosing and said rod being slidingly retained by said piston, said rod being configured to pressurize hydraulic fluid as it slides through the piston thereby causing said second hydraulic fluid flow.

11. The hydraulic pump of claim 10, wherein said rod has a surface along a length of said rod, said rod including at least one of a groove along said surface and a fluid passageway having an end through said surface.

12. The hydraulic pump of claim 11, wherein said rod has a plurality of grooves along said surface.

13. The hydraulic pump of claim 10, wherein said rod side chamber and said piston side chamber being in fluid communication depending on at least one of a direction that said rod is moved relative to said housing and a position of said rod relative to said piston.

14. The hydraulic pump of claim 10, wherein one of said plurality of valves includes a valve that allows a fluid flow from said piston side chamber to said rod side chamber if a pressure of a fluid in said piston side chamber relative to a pressure in a fluid in said rod side chamber is above a predetermined value.

* * * * *